US005341455A

United States Patent [19]

De' Longhi

[11] Patent Number: 5,341,455

[45] Date of Patent: Aug. 23, 1994

[54] OIL RADIATOR WITH WELDED PLATE RADIATING ELEMENTS HAVING FOLDED PORTIONS PROVIDING COOL PLANAR LATERAL OUTER SURFACES FOR PREVENTING INJURIES

[75] Inventor: Giuseppe De' Longhi, Treviso, Italy

[73] Assignee: Miralfin S.R.L., Treviso, Italy

[21] Appl. No.: 885,127

[22] Filed: May 18, 1992

[30] Foreign Application Priority Data

Feb. 18, 1992 [IT] Italy ..... MI92U000138[U]

[51] Int. Cl.[5] ..... H05B 1/00; F28D 1/03; F28F 3/12; F24H 3/00

[52] U.S. Cl. ..... 392/378; 165/130; 165/131; 219/530; 219/540; 237/16; 392/357

[58] Field of Search ..... 392/375–378, 392/356–359; 165/128, 129, 130, 131; 237/16–18; 219/530, 540

[56] References Cited

U.S. PATENT DOCUMENTS

| | | | |
|---|---|---|---|
| 452,828 | 5/1891 | Bond | 165/130 |
| 1,667,357 | 4/1928 | Pickering et al. | 165/130 |
| 1,757,534 | 5/1930 | Lindstrom et al. | 165/130 |
| 1,975,957 | 10/1934 | Kuenstler | 165/130 |
| 2,651,506 | 9/1953 | Lehmann | 165/130 |
| 2,752,125 | 6/1956 | Modine | 165/130 |
| 4,036,287 | 7/1977 | Perani | 165/129 X |
| 4,212,350 | 7/1980 | Andreoli | 165/129 |
| 4,468,195 | 8/1984 | Sasaki et al. | 432/36 |
| 4,764,662 | 8/1988 | Andersen et al. | 219/521 |
| 5,001,327 | 3/1991 | Hirasawa et al. | 219/390 |
| 5,080,039 | 1/1992 | Kanegae et al. | 219/390 |

FOREIGN PATENT DOCUMENTS

| | | | |
|---|---|---|---|
| 354537 | 6/1922 | Fed. Rep. of Germany | 165/129 |
| 127190 | 8/1928 | Fed. Rep. of Germany | 165/129 |
| 482810 | 9/1929 | Fed. Rep. of Germany | 392/375 |
| 1915629 | 1/1970 | Fed. Rep. of Germany | 165/129 |
| 1934780 | 1/1970 | Fed. Rep. of Germany | 165/129 |
| 1909128 | 9/1970 | Fed. Rep. of Germany | 165/130 |
| 2360229 | 6/1975 | Fed. Rep. of Germany | 165/129 |
| 2440184 | 3/1976 | Fed. Rep. of Germany | 165/129 |
| 2509390 | 9/1976 | Fed. Rep. of Germany | 165/129 |
| 2530260 | 1/1977 | Fed. Rep. of Germany | 165/129 |
| 2725081 | 12/1978 | Fed. Rep. of Germany | 165/129 |
| 2290645 | 6/1976 | France | 165/129 |
| 428405 | 12/1947 | Italy | 165/129 |

*Primary Examiner*—Anthony Bartis
*Attorney, Agent, or Firm*—Herbert Dubno

[57] ABSTRACT

An oil radiator, particularly for heating rooms, includes a main body defined by a plurality of mutually associated radiating elements in which a diathermic oil heated by an electric resistor circulates. Each radiating element includes a pair of mating shaped plate-like elements joined together by welding to form an oil receiving space therebetween and each having lateral surfaces provided with a series of folds which mate with the corresponding folds of the other plate-like element to define a channel-shaped air flow compartment capable of lowering the surface temperature of the oil radiator below that of the oil contained in the radiator, thus reducing burn injuries caused by inadvertent contact with the radiator. The folds also cooperate to provide the radiator with planar lateral outer surfaces to minimize impact injuries caused by collision with the radiator. During operation cold air flows upwardly through the channel-shaped compartments and is heated so that the radiator propagates heat by convection and radiation.

1 Claim, 8 Drawing Sheets

OIL RADIATOR WITH WELDED PLATE RADIATING ELEMENTS HAVING FOLDED PORTIONS PROVIDING COOL PLANAR LATERAL OUTER SURFACES FOR PREVENTING INJURIES

FIELD OF THE INVENTION

The present invention relates to an oil radiator structure particularly for heating rooms.

BACKGROUND OF THE INVENTION

As is known, current radiators suitable for heating one or more rooms comprise a battery of mutually associated radiating elements inside which a hot fluid, for example a diathermic oil, is contained and is heated by an electric resistor.

In this type of radiator, heat propagation occurs essentially in two ways: by conduction and by convection.

Heat propagation by conduction occurs between the internal surfaces of the oil radiator which are in contact with the hot fluid and the outer surfaces, which despite being spaced from the hot fluid, in a short time reach the same temperature as the fluid.

Heat transmission by convection occurs with the transfer of heat from the hot outer surface of the oil radiator to the air particles which surround it.

As the air particles receive heat, they move in a substantially vertical direction and are replaced by colder particles to be heated.

From what has been described above it can be seen that the surface temperature of known radiators is practically equal to the temperature of the hot fluid which circulates inside them.

Therefore, in this situation the surface temperature of an oil radiator can be so high that it might cause, in case of contact, burns on the skin of persons.

Therefore, according to the currently applicable statutory provisions on the subject, the surface temperature of an oil radiator must not be high enough to cause possible skin burns.

In order to lower the surface temperature of an oil radiator it is possible to keep the temperature of the fluid inside it within certain values. However, the lowering of the temperature of the fluid of the oil radiator would entail, as can be easily understood, the simultaneous reduction of the heating power of the unit.

It should be furthermore noted that the particular blade-like configuration of the radiating elements of known radiators is highly dangerous, especially for children, in case of possible violent impacts against said elements.

OBJECTS OF THE INVENTION

It is, therefore, an object of the present invention to eliminate the problems described above by providing an oil radiator structure wherein the temperature of its outer surface is much lower than the temperature of the hot fluid contained therein, without thereby reducing its ability to heat the room in which it is installed.

Still another object of the invention is to provide an oil radiator structure having radiating elements each including two parts welded and folded in line by automatic machines.

Another object of the invention is to provide an oil radiator structure which has greater efficiency than known radiators.

A further object of the invention is to provide an oil radiator structure whose outer surface is substantially planar and thus extremely safe.

A further object of the invention is to provide an oil radiator structure wherein the radiating element is welded prior to the execution of the folds.

Yet a further object is to provide an oil radiator structure particularly for heating rooms which, for an equal temperature of the hot fluid of a conventional oil radiator, has a distinctly higher exchange of heat by convection than the latter.

SUMMARY OF THE INVENTION

These objects are achieved by an oil radiator structure according to the invention particularly for heating rooms, with a hot fluid circulating inside thereof and including at least one first plate-like element. Each lateral surface of the plate-like element has at least a first fold and a second fold for reducing the heat on the outer perimetric surface of the radiating element and for simultaneously increasing the efficiency thereof.

BRIEF DESCRIPTION OF THE DRAWING

The above and further objects, characteristics and advantages will become more readily apparent from the following description of an oil radiator structure according to the invention, reference being made to the accompanying drawing, wherein:

FIG. 18A is a cross section of the embodiment shown in FIG. 18 taken along lines XVIIIA—XVIIIA; and;

SPECIFIC DESCRIPTION

Figure 1:
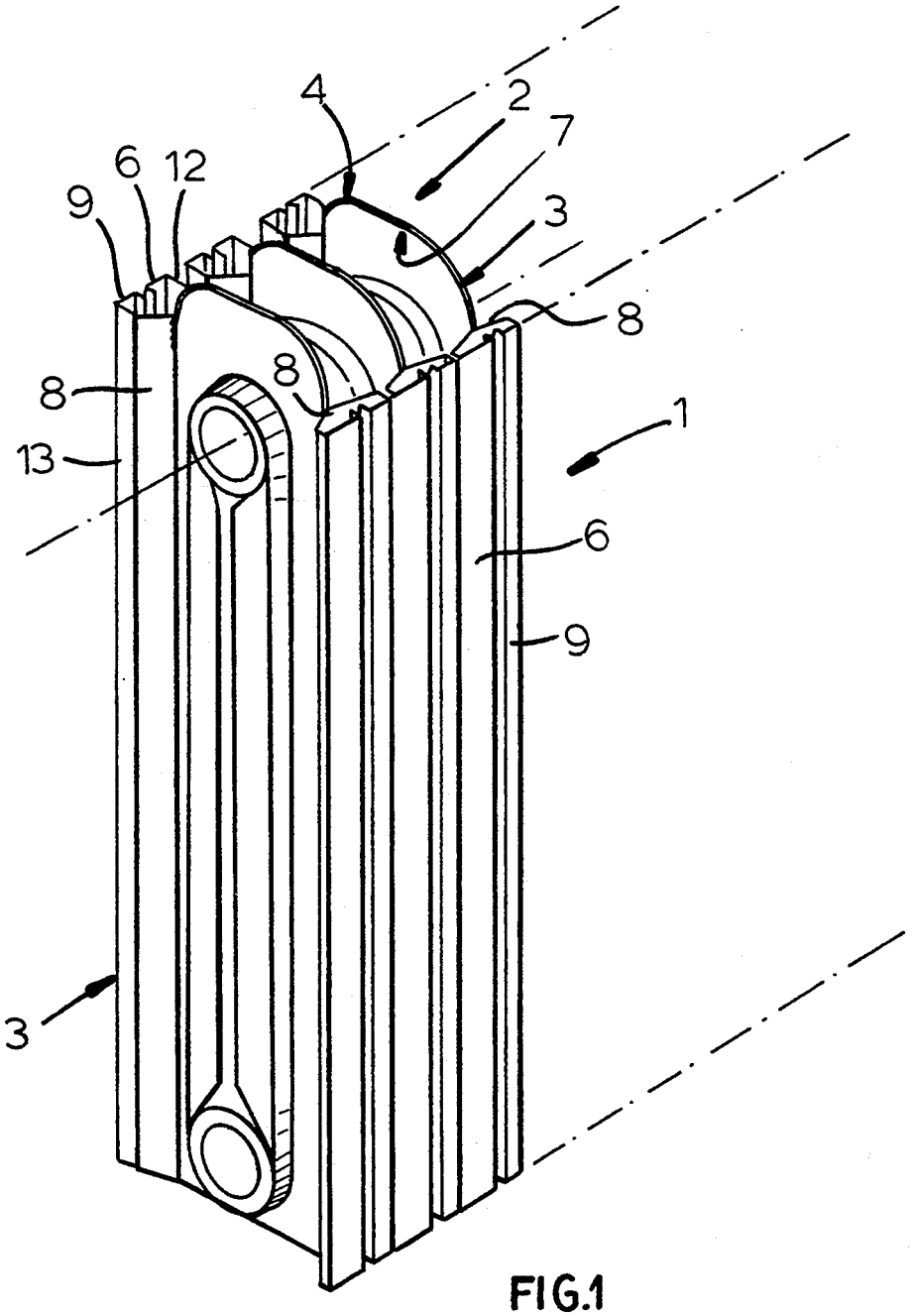
FIG. 1 is a partial perspective view of the oil radiator structure according to the invention.
Figure 2:
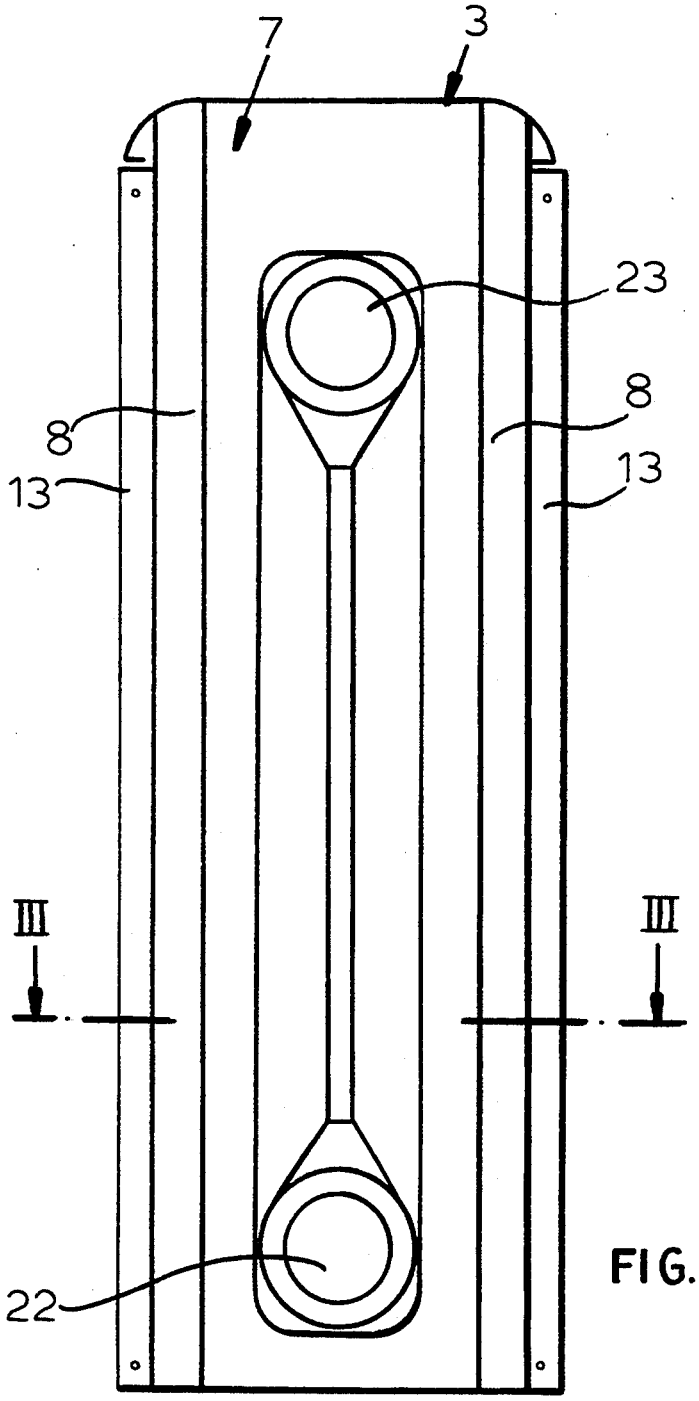
FIG. 2 is a front elevation view of a radiating element of the oil radiator according to the invention.
Figure 18:
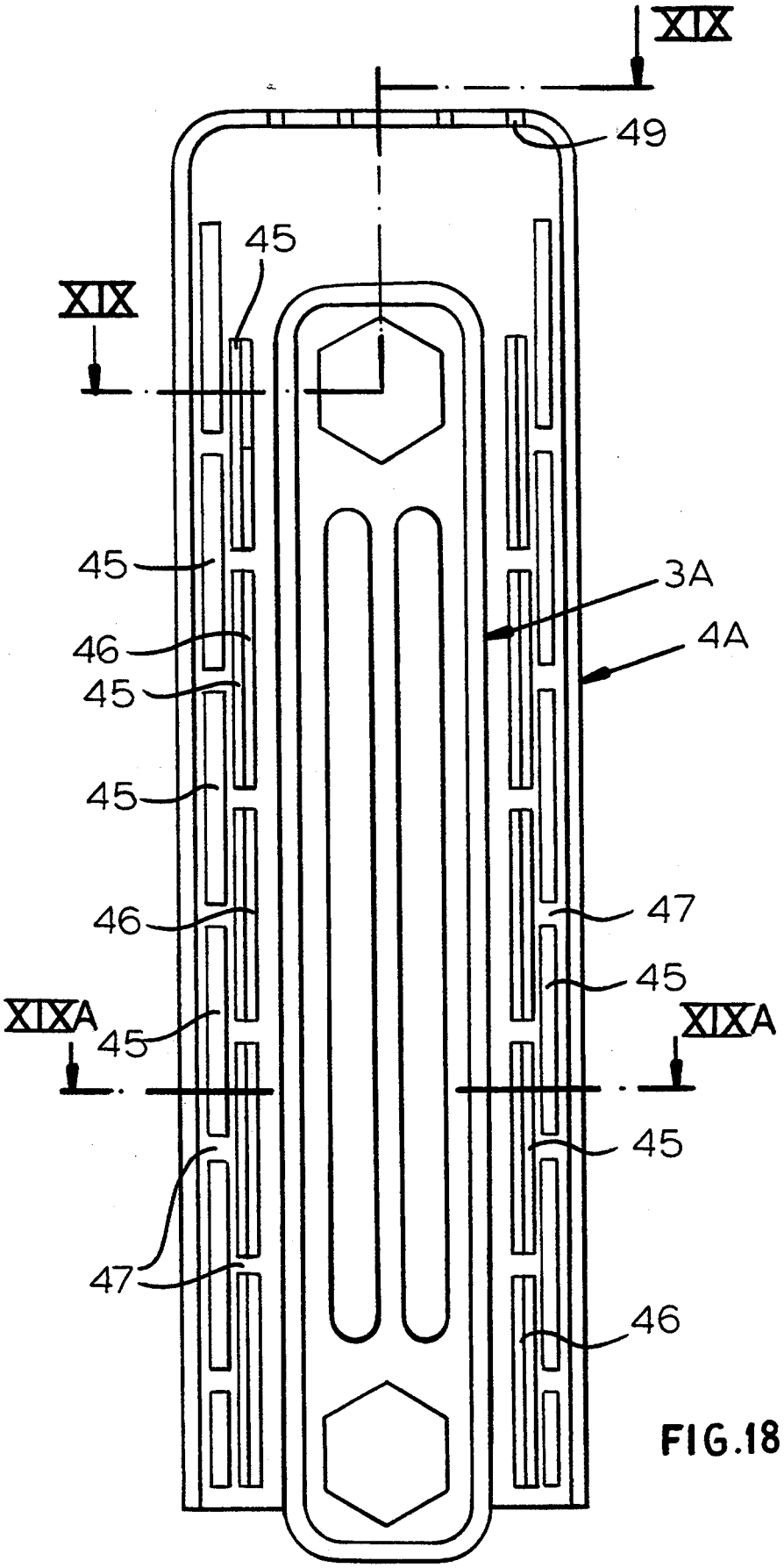
FIG. 18 is a front elevation view of a radiating element of the oil radiator shown in FIG. 17, according to the invention.
Figure 19:
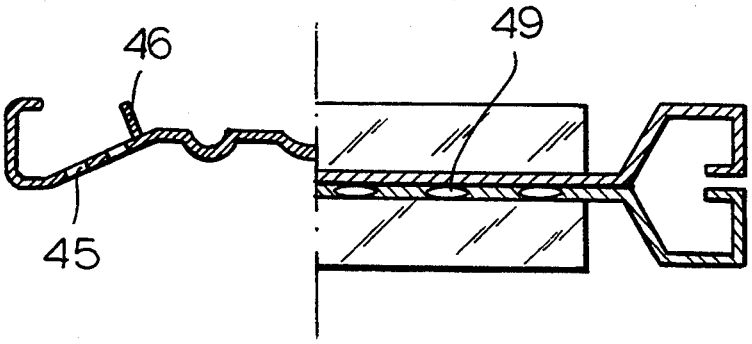
FIG. 19 is a sectional view, taken along the plane XIX—XIX of FIG. 18, according to the invention.
Figure 19A:
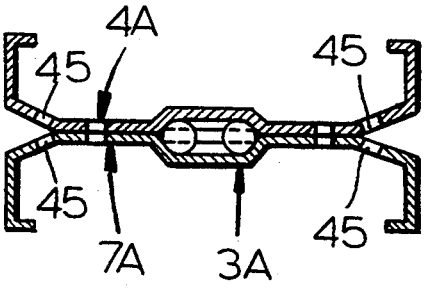
FIG. 19A is a cross section of the embodiment shown in FIG. 18 taken along lines XIXA–XIXA.

The oil radiator structure for heating rooms, generally designated by the reference numeral 1 (FIG. 1), comprises a main body, generally designated by 2, which is defined by a plurality of radiating elements, each designated by 3, in a first embodiment illustrated in FIGS. 2 and 3A in a second embodiment illustrated in FIG. 18. FIG. 19A is a cross section of the embodiment shown in FIG. 18 taken along lines XIXA—XIXA; and Inside the radiating elements there is a hot fluid, and more specifically an insulating oil, which is heated by an electric resistor.

Each of the radiating elements 3 comprises at least one first plate-like element 4. Each lateral surface of the plate-like element has at least a first fold and a second fold, respectively designated by the reference numerals 5 and 6, for reducing the heat on the outer perimetric surface of the radiating element and for simultaneously increasing the efficiency of the radiating element.

Each radiating element 3 furthermore comprises a second plate-like element 7 which has at least a portion, proximate to the first and second folds 5 and 6, which mates perfectly with the corresponding portion of the first plate-like element 4, so that it can be associated therewith, for example by welding.

The second plate-like element 7 also has at least a first fold 8 and a second fold 9 whose width and orientation are perfectly symmetrical with respect to those of the first and second folds 5 and 6 of the first plate-like element 4.

In particular, the first plate-like element 4 also comprises at least a third fold 10 which, for the second plate-like element 7, has been designated by the reference numeral 11.

Figure 3:
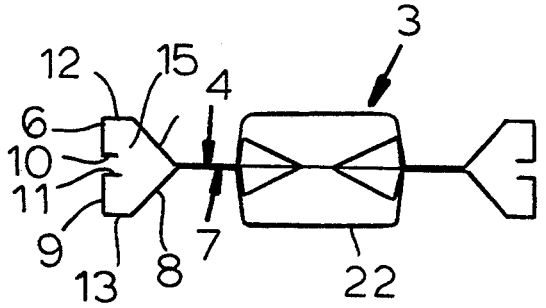
FIG. 3 is a sectional view, taken along the line III—III of FIG. 2, according to the invention.

For example, the radiating element 3, illustrated in FIG. 2 and in a sectional view in FIG. 3, also has a fourth fold 12 of the first plate-like element 4 and a fourth fold 13 of the second plate-like element 7.

In this case, the various folds of the first plate-like element 4, together with the various folds of the second plate-like element 7, define a channel-shaped compartment 15 which is capable of lowering the surface temperature of the oil radiator and in particular of the surfaces defined by the folds 6 and 9 of FIG. 3, although the temperature of the liquid inside the radiator is kept at a high value and so as to assure a considerable ability to heat the room in which the oil radiator is installed.

By virtue of the type of fold shown in FIGS. 6 to 10, it is possible to obtain, by mutually associating a plurality of radiating elements 3, a lateral outer surface of the oil radiator, which is perfectly planar and thus able to assure maximum safety even in case of possible collisions with it.

Figure 4:
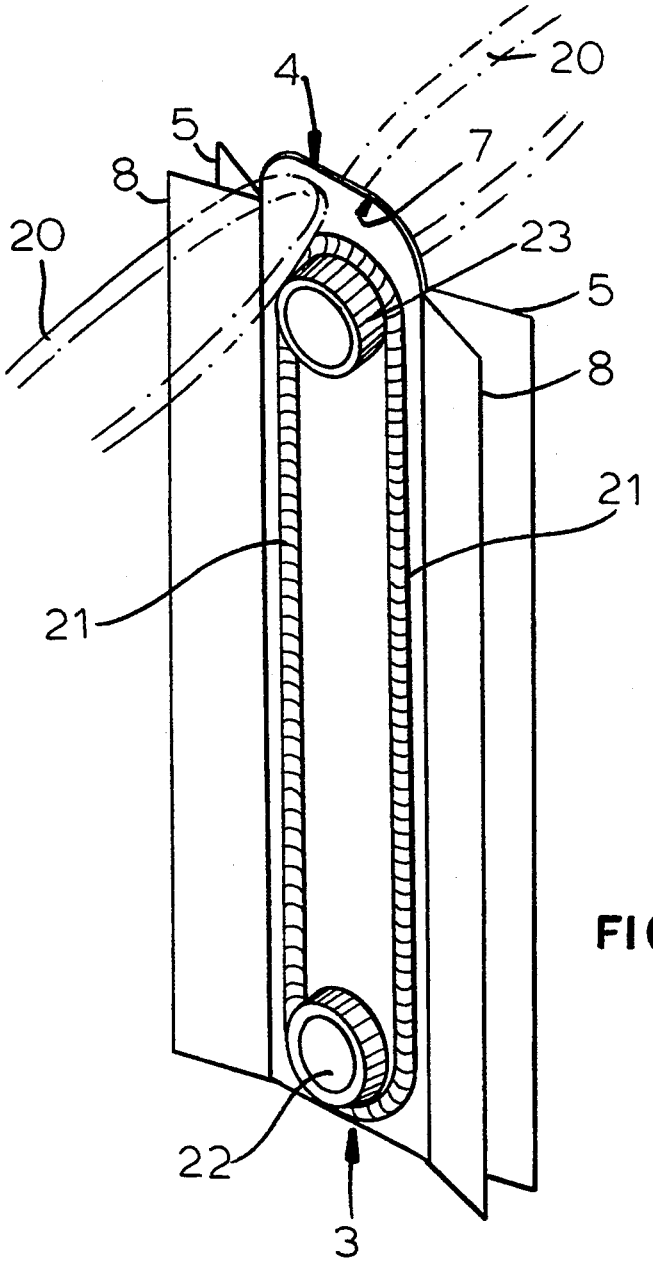
FIG. 4 is a diagram which shows how the radiating element is welded before its lateral edges are folded according to the invention.
Figure 5:
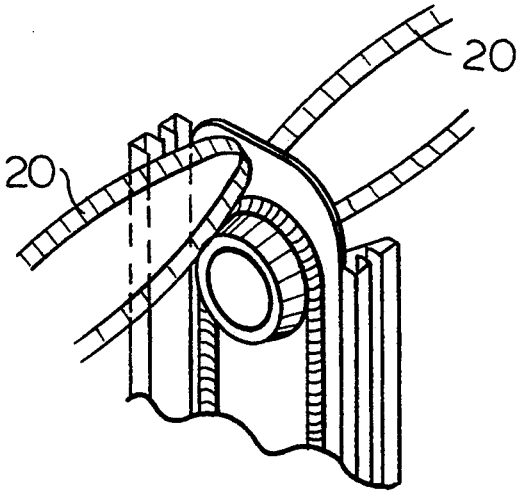
FIG. 5 PRIOR ART
FIG. 5 is a diagram which shows how, according to the prior art, it is impossible to weld after folding the lateral edges of the radiating element.

In particular by observing FIGS. 5 and 4, which show the welding of the radiating element according to the known art and according to the present invention.

A radiating element of an oil radiator is currently welded in line on automatic machines which are equipped with welding rollers, designated by 20, which during welding follow the path 21 which leads from a hub 22 to a hub 23 for connecting one radiating element to the next one.

During welding around the hubs 22 and 23, the welding rollers 20 must turn through a 180° curve and thus collide against the folded edges of each radiating element 3.

In other words, it is impossible to weld the first and second plate-like elements 4 and 7, if they have small transverse dimensions, after the lateral edges of the radiating elements 3 have been folded.

Therefore, in order to obviate this problem, welding according to the invention is performed prior to the folding of the lateral edges of each radiating element.

As can be seen in FIG. 4, only the first folds 5 and 8 are performed respectively on the plate-like elements 4 and 7 in the direction opposite to the direction of the remaining folds.

At this stage each radiating element is welded, by means of the welding rollers 20, by passing the welding rollers around the hubs 22 and 23: in this case, said rollers are not hindered at all by the first folds 5 and 8.

Figure 10:
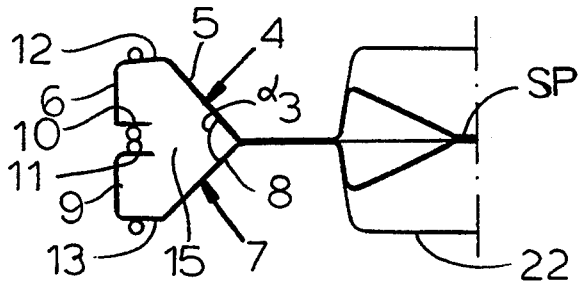
FIGS. 6 to 10 show the steps of the folding of the edges of the radiating element once the welding operation has been performed thereon according the invention.
Figure 9:
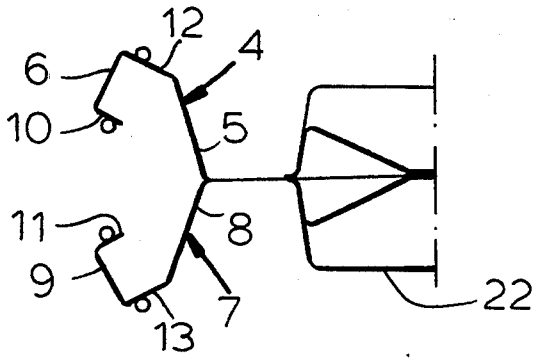
Figure 8:
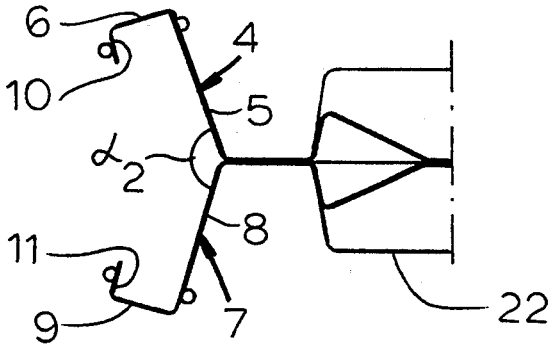
Figure 7:
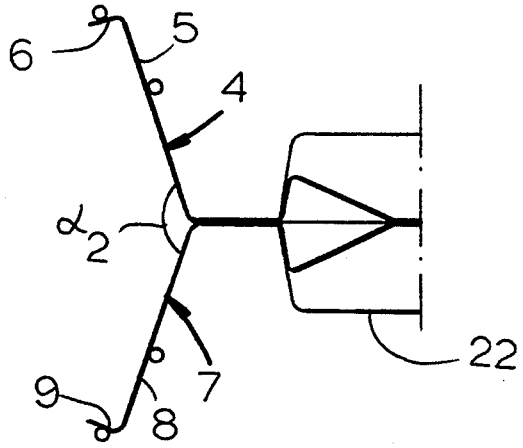
Figure 6:
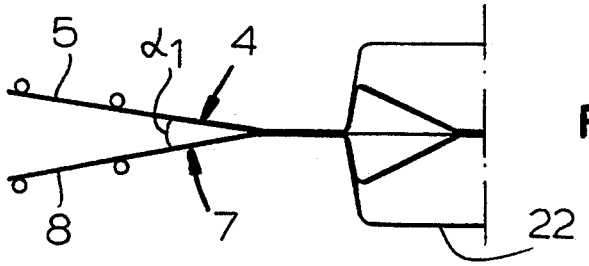

The welding operation is performed according to the steps shown in FIGS. 6 to 10, all the folds required to obtain the radiating element according to the present invention are subsequently performed in different steps. Particularly, FIG. 6 shows the initial stage of the method. An angle $\alpha 1$ between plates 4 and 7 is acute. Upon welding the plates bend away from one another and further, as is seen in FIGS. 7–10, different angles $\alpha 2$ and $\alpha 3$ are applied to respective end portions at the flaps. The resulting structure shown in FIG. 10 is analogous to the one seen in FIG. 3.

In practice it has been observed that the oil radiator structure according to the invention is particularly advantageous in that although a hot fluid flows inside it, it allows maintenance of the outer surfaces at a considerably lower temperature which is well within the applicable statutory provisions on the subject but allows a higher oil radiator efficiency than the radiators of the known art.

Figure 13:
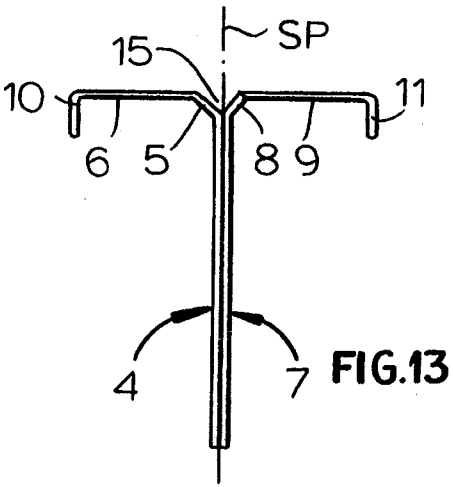
FIGS. 11 to 16 are sectional views of the various types of fold which can be performed according to the invention.
Figure 12:
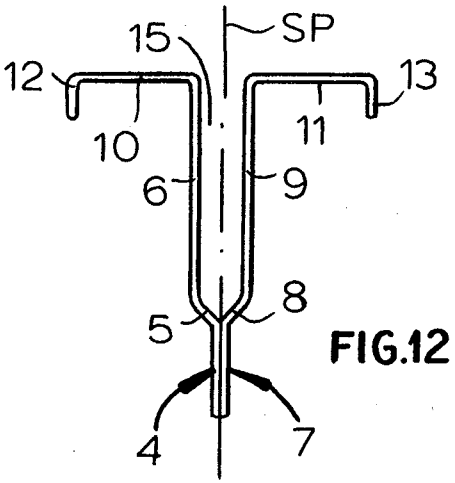
Figure 11:
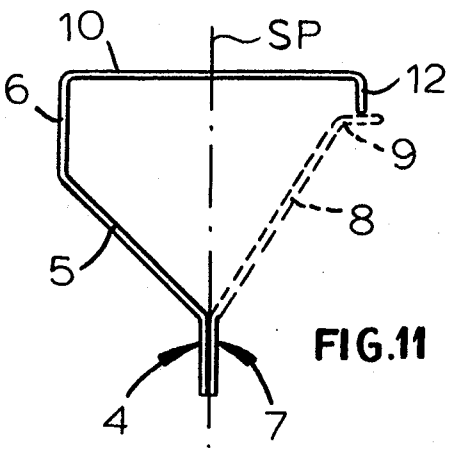
Figure 16:
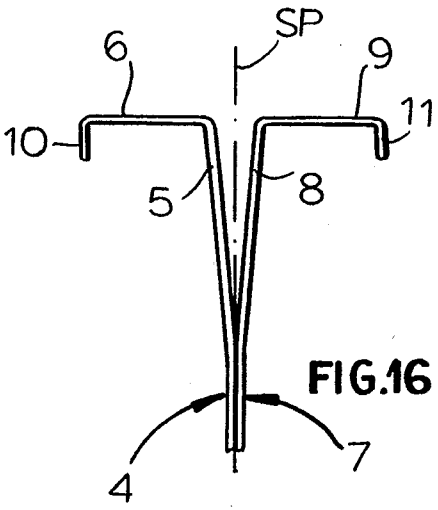
Figure 15:
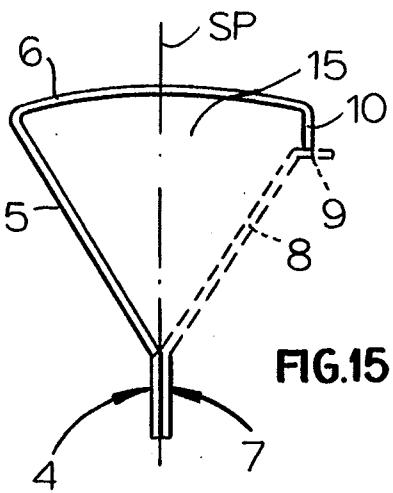
Figure 14:
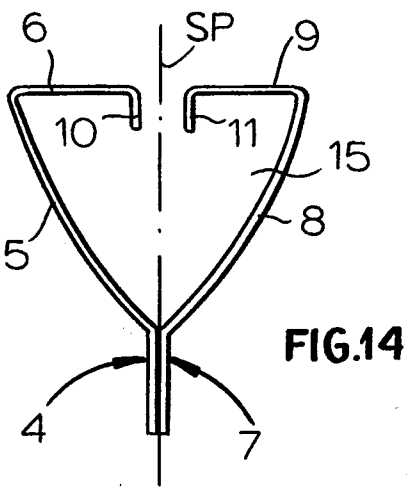
Figure 17:
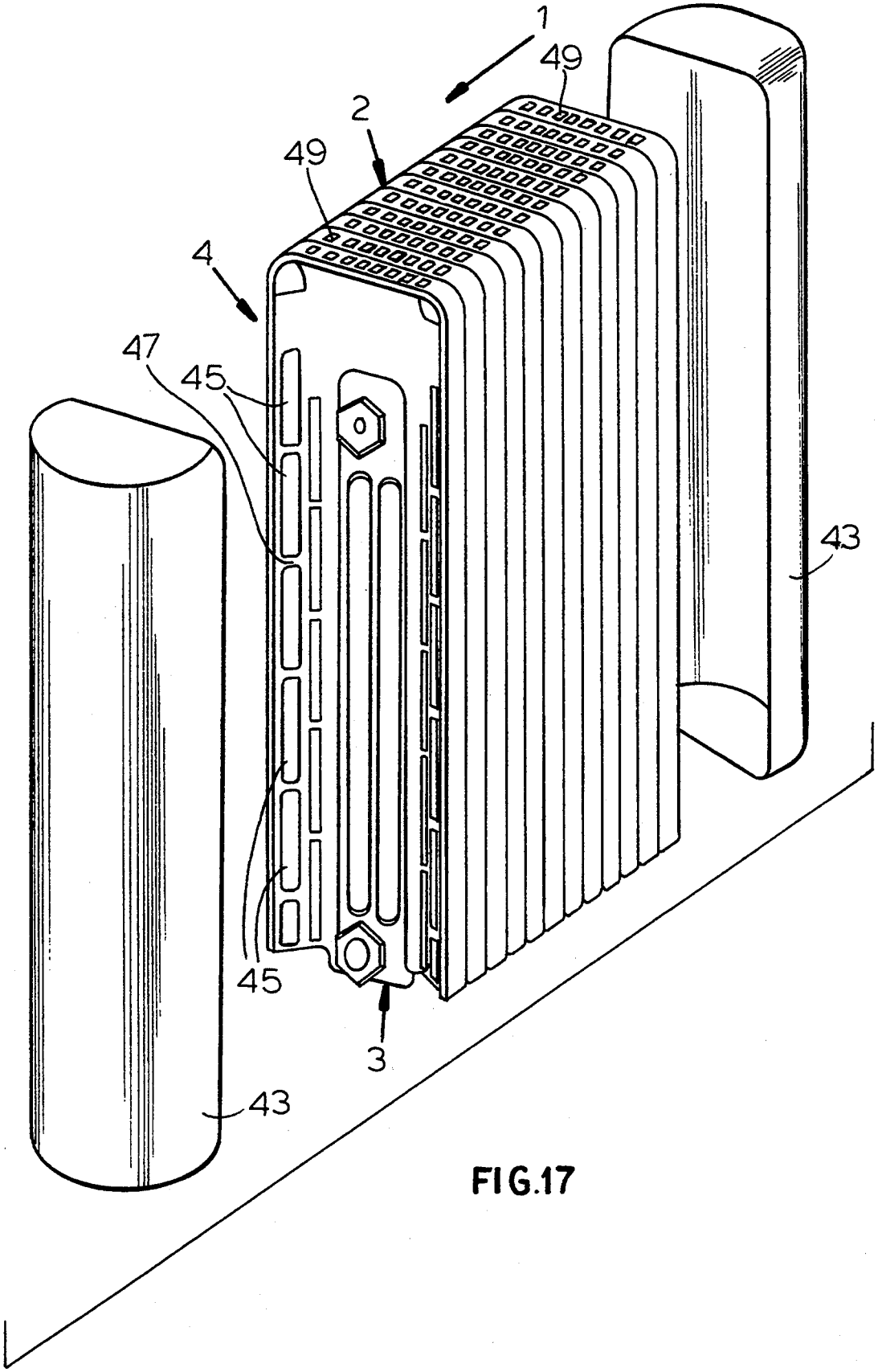
FIG. 17 is a partially exploded perspective view of the oil radiator structure according to a different embodiment.

FIGS. 11–16 show different shapes of the radiating element according to the invention. FIGS. 12, 13 and 16 show flaps 5 and 8 formed with respective flanges 5 and 9 extending in opposite directions and outwardly from the symmetry plan "SP" and provided at respective end portions with flaps 10, 11. FIG. 14 shows an embodiment of the invention which is close to the one shown in FIG. 3 but with flaps 5 and 8 being curved. FIGS. 11 and 15 show a further embodiment having one flap 5 formed with flanges 6 and 10. As an additional feature, the flap 8 can also be used.

Furthermore, by virtue of the particular folding of the plate-like elements of the oil radiator, the side walls of said oil radiator are substantially planar and free from discontinuities, thus also ensuring absolute safety in case of possible impacts against it.

In a different embodiment, illustrated in FIG. 18, each plate-like element 4A has a plurality of openings 45, some of which have elements 46 for redirecting the air which circulates between the adjacent plate-like elements.

As can be seem in FIG. 18, the openings 45 and the redirection elements 46 are accommodated mainly in a perimetric portion of the plate-like element and are advantageously produced at the same time as the radiating element, thus considerably reducing production costs and times.

More particularly, the plate-like element 4A comprises bridges, each of which is designated by 47, which are comprised between the openings 45. The bridges have dimensions suitable for limiting the transmission of heat by conduction from the radiating element 3A to the outer surface of the plate-like element. When several radiating elements are mutually associated so as to define the oil radiator, the openings 45, together with the redirection elements 46, define preferential air flow channels inside the oil radiator so as to heat by convection a considerable volume of the air which, also by virtue of the presence of holes 49 arranged in an upper region of each plate-like element, can exit therefrom.

Finally, it should also be mentioned that the body 2A of the oil radiator comprises two elements 43 for closing the end surfaces of the radiator and, in the case of the oil radiator shown in FIG. 1, the body 2 can be covered by a grille, not shown in the drawings.

Closure elements have any shape, for example a substantially hollow half-cylindrical one, and known connection means, for example of the snap-together type, for their rapid association with the body 2A of the oil radiator.

The operation of the oil radiator according to the invention is evident from what has already been described and illustrated.

In particular, as can be easily understood, the cold air is drawn from below the body of the oil radiator 2 and, by virtue of the presence of the channel-shaped compartments 15, can circulate inside each radiating element, flowing along a larger exchange surface than a conventional oil radiator and following the preferential channels which are defined, besides, for example in the constructive variation of FIG. 18, both by the redirection elements 46 and by the openings 45, and exit from the holes 49 which are connected thereto.

FIG. 19A shows a cross section of the embodiment illustrated in FIG. 18. As is seen, each plate 4A and 7A has a flat portion and a flap extending angularly from the symmetry plan.

In practice, the materials employed, as well as the dimensions, may be any according to the requirements and the state of the art.

I claim:

1. An oil radiator for heating a room including:

a plurality of radiating elements connected to one another in succession along a longitudinal axis and having mutually parallel symmetry planes extending perpendicular to said axis, each of said radiating elements being formed with by a respective pair of mutually symmetrical plates disposed on opposite sides of a respective one of said symmetry planes, each of said plates of a respective one of said pairs being formed with:

a respective generally part lying substantially in the respective symmetry plane, welded to the flat part of the other plate of the pair and defining inwardly of the flat part a space within which an oil heating medium is disposed, said flat parts having vertical outer ends, and a respective flap on a respective one of said outer ends and inclined to said plane of symmetry and having a first length, each of said flaps being formed with a respective remote end spaced from a respective one of said outer ends, said flat parts of said pair of plates lying against one another, said flaps of said pair of plates flaring away from one another and symmetrically to the respective symmetry plane, a respective intermediary flap extending from a respective one of said distant ends parallel to one of said planes of symmetry and formed with a respective outer end, said intermediary flap being formed with a second length less than said first length, a respective flap tab on a respective one of said outer ends and formed with a respective third length less than said first length but greater than said second length, said flap tab extending from a respective one of said outer ends toward one of said planes of symmetry, said flap tabs of said plates extending perpendicular to said symmetry planes in opposite directions and forming opposite planar vertical outer surfaces of said radiating elements, said flap tabs being folds formed subsequent to welding of said plates of said radiating elements together and forming respective continuous side walls of the oil radiator perpendicular to said symmetry planes, and a respective end flap formed on a respective one of said flap tabs and extending parallel to said one plane of symmetry toward said heat exchanger, said end flaps, folds, intermediary flaps and tabs of each pair forming an airflow region preventing said side walls from heating up to a temperature equal to a temperature of the heating element.

* * * * *